United States Patent [19]

Mettler

[11] Patent Number: 4,457,151

[45] Date of Patent: Jul. 3, 1984

[54] METHOD OF RECALIBRATING A WORN CONICAL, ESPECIALLY CURVED TUBULAR MOLD

[75] Inventor: Diethelm Mettler, Küsnacht, Switzerland

[73] Assignee: Accumold AG, Fischenthal, Switzerland

[21] Appl. No.: 345,090

[22] Filed: Feb. 2, 1982

Related U.S. Application Data

[63] Continuation of Ser. No. 164,353, Jun. 30, 1980, abandoned.

[30] Foreign Application Priority Data

Jul. 20, 1979 [CH] Switzerland ..... 6768/79

[51] Int. Cl.[3] ..... B21D 26/08

[52] U.S. Cl. ..... 72/56; 29/402.19; 29/421 E

[58] Field of Search ..... 164/6; 29/421 E, 505, 29/525, 402.19; 72/56; 228/107

[56] References Cited

U.S. PATENT DOCUMENTS 3,646,799 3/1972 Kipp et al. ..... 164/6 X 3,927,546 12/1975 Shrum ..... 72/56

4,081,983 4/1978 Shrum ..... 29/421 E

FOREIGN PATENT DOCUMENTS 2533528 2/1976 Fed. Rep. of Germany .

*Primary Examiner*—Nicholas P. Godici

*Assistant Examiner*—J. Reed Batten, Jr.

*Attorney, Agent, or Firm*—Werner W. Kleeman

[57] ABSTRACT

A worn conical tubular mold, exhibiting irreparable surface flaws or defects at the inner tubular wall of the mold at the location of the former region of the molten bath level existing in the tubular mold when the same was previously used during continuous casting, is formed or reformed through the use of an explosive forming technique with the aid of a calibration arbor or mandril so as to possess a new reversed taper. As a result, the surface flaw or defect now is located at the region of what becomes the new strand outlet of the reformed tubular mold and unimpaired, fissure-free mold wall material comes to lie at the region of the tubular mold where there will appear the new molten bath level when the reformed tubular mold then is again used for casting purposes.

5 Claims, 1 Drawing Figure

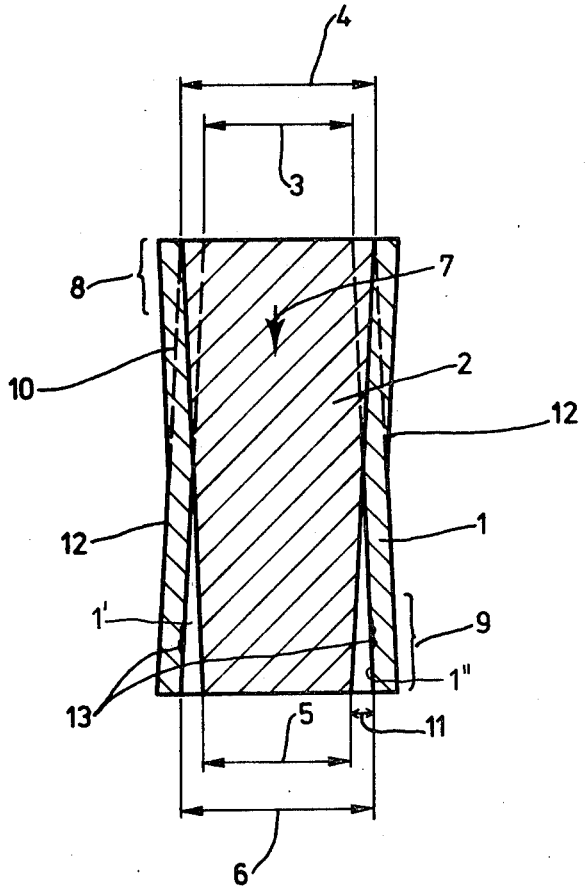
4
3
8
7
10
2
12
12
1
1'
9
1"
13
5
11
6

METHOD OF RECALIBRATING A WORN CONICAL, ESPECIALLY CURVED TUBULAR MOLD

CROSS REFERENCE TO RELATED APPLICATION

This application is a continuation to my commonly assigned, copending U.S. application Ser. No. 164,353, filed June 30, 1980, now abandoned.

BACKGROUND OF THE INVENTION

The present invention relates to a new and improved method for the recalibration or reforming of a worn, conical, especially curved tubular mold for use in continuous casting of strands.

Generally speaking, the method of the invention contemplates introducing a calibration arbor or mandril into the hollow compartment of the mold, applying an explosive charge to the outer surface of the tubular mold, detonating the explosive charge and through such detonation deforming or reforming the hollow compartment or cavity of the tubular mold to the dimensions of the calibration arbor or mandril.

During the continuous casting of metals, especially steel, there are used throughpass molds having straight or curved shapes. Generally, the walls of such molds, forming the hollow mold compartment or cavity are fabricated of copper or copper alloys. When continuously casting smaller strand sectional shapes, for instance billets and smaller bloom sections, as a general rule, these molds are formed of tubular elements or tubes. In order to compensate the shrinkage, frequently pronounced for many steel qualities, of the strand solidifying at its surface within the mold, in order to afford adequate strand cooling, it is conventional practice to provide the major portion of the tubular molds with a taper which converges towards the outfeed side of the strand. The continuous casting molds are exposed to wear, particularly at the region of the molten bath level within the mold and, especially, when the continuous casting mold is used at casting installations working with bath level regulation systems. This wear of the mold results in damage of the mold surface, such as typified for instance by large surface pitting and frequently deeply penetrating fissures, especially in the case of tubular molds at which there has been accomplished a high number of pours.

Moreover, unavoidable thermal stresses lead to a contraction of the tubular mold at the region of the molten bath level, and to an enlargement, which is intensified by abrasion or wear, at the strand withdrawal end of the continuous casting mold, thus resulting in undesired, incorrect taper.

The fabrication of a drawn, conical tubular mold with the requisite smallest possible tolerances, requires a great expenditure in equipment, and therefore, is associated with appreciable costs, especially in the case of tubular molds having a curved, hollow mold compartment. In order to increase the service life of such expensive tubular molds by repairing or reworking the same, there have been developed special techniques for recalibrating such molds. Tubular molds having different tapers could not be recalibrated.

At the present time, spent molds, exhibiting practically unchanged taper and essentially only insignificant damage or flaws, such as, for instance, surface fissures at the inner wall of the tubular mold, following the formation of a mold fissure are subjected to a mechanical machining operation, such as, for instance grinding, planing and so forth of the mold inner surface in order to rework the mold so that it can again be reused for casting purposes. Yet, such procedures are automatically associated with an enlargement in the format or shape of the mold, frequently amounting to several millimeters. In most instances, such enlargement of the dimensions of the mold cannot be tolerated because of the thereafter performed processing of the cast strand material, for instance at a rolling mill, owing to the there prevailing pass gauge.

These drawbacks have been partially overcome through the use of a technique known to the art from German Pat. No. 2,533,528, but up to now not very frequently employed. With this prior art technique it is possible to produce conical, but also different conical, bent or curved molds by deforming a blank over a die by means of an explosive charge, and additionally with the same technique to reduce in size a spent tubular mold which has been enlarged by wear back to its original mold dimensions. With this procedure, the walls of the hollow mold compartment, as a rule, again should have imparted thereto the characteristics of a new casting mold.

In practice, however it has been found that the deeply penetrating fissures which are formed due to the previously mentioned bath level regulation, no longer can be eliminated by the described recalibration technique. During the explosive deformation there results an overlapping of the walls of the fissures, so that there arise unacceptable surface defects or flows, even if there has been accomplished a subsequent chrome plating of the mold walls. Hence, it is not possible to reuse such processed tubular molds because of the poor surface quality of the cast strand which will be formed in such reprocessed molds. In particular, upon renewed use of such repaired tubular mold, back in its original casting position, the only partially closed wall fissures again are located at the region of the greatest thermal stresses, tend to again open-up and liquid steel could penetrate into the open fissures, which, in turn, could lead to metal break-out and furthermore, to the formation of holes in the mold wall associated with dangerous escape of the cooling water. On the other hand, deep grinding of the fissures, prior to the explosive deformation work, which would be necessary in order to avoid such overlapping of the walls of the fissures, would result in an impermissible weakening of the mold walls at the corresponding regions of the tubular mold which is thus machined. These continuous casting molds no longer can be employed in casting operations, and therefore, only have scrap value with the present state of this technology. Since it is becoming more and more commonplace to use bath level-regulation devices, it should be apparent that the number of such type damaged tubular molds is ever increasing. Hence, the advantage of the exact regulation of the molten bath level is adversely offset by increased mold rejects.

SUMMARY OF THE INVENTION

Therefore, with the foregoing in mind, it is a primary object of the present invention to provide a new and improved method of recalibrating a worn conical, especially curved, tubular mold, in a manner not associated with the aforementioned limitations and drawbacks of the prior art techniques.

Another and more specific object of the present invention aims at a new and improved method for recalibrating a markedly worn, tubular mold, which otherwise merely could be scrapped, and thus increasing the service life of the tubular mold, the recalibration operation being accomplished with lesser cost than the cost of procuring a new tubular mold.

Still a further significant object of the present invention aims at providing a new and improved method of recalibrating a worn continuous casting mold in an extremely reliable, economical and efficient manner, affording increased service life of the relatively expensive tubular molds.

Now in order to implement these and still further objects of the present invention, which will become more readily apparent as the description proceeds, the method aspects of the present development contemplate that, in the case of conical tubular molds, a conically formed calibration arbor is inserted with its smaller end surface, from the side of the tubular mold which previously constituted the strand outlet side of such spent tubular mold, and the strand outlet side is deformed by the explosive force of an explosive charge, so that it becomes the pouring-in side for the casting metal and the tubular mold is reused during continuous casting.

By means of the inventive method it is possible to provide a conical casting mold with a reverse or inverse taper, i.e. the original strand outlet side of the spent mold is reformed so as to constitute the metal pouring-in side or metal inlet of the recalibrated mold. Hence, the aforementioned remaining defects or flaws, which were present at the former region of the bath level prior to recalibration of the mold, now appear at the region of the new strand outlet or exit end of the mold. These flaws or defects, at this location, do not have any negative affect upon the solidification behaviour of the strand, in contrast to when such flaws were present at the region of the molten bath level. This is so because when the flaws are located at the strand exit region of the continuous casting mold, they are at a location of the mold where there has already formed a strand shell or skin, liquid steel no longer has access to the mold wall, and therefore cannot penetrate into the fissures. Hence, there are effectively avoided the formation of surface defects at the solidified strand and break-out of the metal of the strand in the mold. A tubular mold, which heretofore was destined to be scrapped, can again be employed, following the inventive recalibration, for at least one further casting operation.

In many fields of application, it can be advantageous if the cross-sectional area of the original strand exit or outlet side of the casting mold is enlarged in order to facilitate introduction of the arbor or mandril. This can be advantageously realized by explosive deformation, wherein beneficially explosive charges, which have been placed at the four corners of the hollow mold compartment and essentially at the intermediate region of the outer surface of the tubular mold are simultaneously detonated.

Due to such widening or enlargement of the end of the tubular mold which is smaller in cross-sectional area prior to recalibration, it is also possible to insert, without any great effort, the calibration arbor or mandril even into tubular molds which have been markedly contracted at the region of the molten bath level. Due to application of the explosive charge, there is obtained a uniform enlargement of the cross-sectional area at all sides. Consequently, it is possible to recalibrate and thus restore for reuse tubular molds which heretofore no longer could be used or reformed because of the previously described contraction and the therewith associated intolerable taper changes.

BRIEF DESCRIPTION OF THE DRAWING

The invention will be better understood and objects other than those set forth above will become apparent when consideration is given to the following detailed description thereof. Such description makes reference to the annexed drawing wherein the single FIGURE illustrates in schematic sectional view a tapered mold undergoing recalibration according to the inventive method.

DETAILED DESCRIPTION OF THE PREFERRED EMBODIMENTS

Describing now the drawing, the single FIGURE illustrates a worn, square tubular mold 1 formed of a copper alloy and used for continuous casting of strands, the mold 1 being shown following insertion of a calibration arbor or mandril 2 into the hollow mold compartment or cavity 1' of the continuous casting mold 1. Both the tubular mold 1 and also the calibration arbor 2 have a conical configuration, and the tapers, as illustrated, partially extend towards one another. Reference characters 3 and 4 designate the edge lengths of the imaginary mold end surface of a region 8 of the original strand outlet or exit side of the mold 1 and the calibration arbor base, i.e. the wider portion of the conical mandril 2. Reference characters 6 and 5 designate a region 9 of the original metal infeed side of the spent mold 1 and the calibration arbor tip, i.e. the narrower portion of the conical mandril 2. At the molten bath level region of the previous metal infeed or pouring-in side 9 of the spent mold 1 there have formed irreparable surface flaws or defects at the inner mold wall 1'', these surface flaws or defects having been generally designated by reference character 13. If the arbor 2 cannot be inserted at its tip into the mold 1 from the original or prior strand outlet end 8 of the spent mold 1, then its cross-sectional area must be enlarged. Such enlargement or widening of this cross-sectional area can be accomplished hydraulically or through the application of other suitable force applying devices. In many cases the explosive deformation technique constitutes an advantageous procedure. To this end, there are placed at the corner regions of the hollow mold compartment 1' along several centimeters thereof and for maintaining the square configuration also at the center of the outer surface of the tubular mold 1 explosive charges which are then simultaneously detonated.

The insertion of the calibration arbor or mandril 2 occurs in the direction of the arrow 7, and the broken line illustrated portion 10 of the tubular mold 1 is further enlarged in conformity with the shape of the calibration mandril 2. The deformation to which the tubular mold portion 10 is subjected to in this manner is partially of a plastic nature, partially of an elastic nature. Between the arbor or mandril tip and the mold walls 1'' of the original metal pouring-in side 9 of the spent tubular mold 1, there is formed an air gap 11, because of the tapers which are directed towards one another. This air gap or space 11, depending upon the shape of the calibration arbor 2, amount to several millimeters.

Now in accordance with the method described in the aforementioned German Pat. No. 2,533,528, to which reference may be readily had and the disclosure of which is incorporated herein by reference, there is then closed the ends of the tubular mold 1 by conventional and therefore not particularaly illustrated base plates, there are applied explosive charges to the tubular mold outer surfaces or sides 12, the tubular mold 1 and the arbor 2 are placed as an assembly or unit into a container filled with a suitable liquid, typically water, and the explosive charges are electrically detonated. Consequently, the tubular mold 1 is plastically deformed so that its internal dimensio;ns assume those of the external dimensions of the calibration arbor or mandril 2, constituting the reference dimension. The original taper of the tubular mold 1 now has been reversed or inversed. In this way there is achieved the beneficial result that unimpaired fissure-free material of the tubular mold now appears at what will become the new bath level of the reformed tubular mold 1 when it is reused for casting purposes, whereas the existing surface flaws or defects 13 are located at the region of what will become the new strand outlet or exit side of the mold, where these surface flaws 13 cannot exert any negative affect upon the quality of the cast strand.

Of course it is possible to recalibrate with the above-described method also tubular molds having all other different cross-sectional and conical configurations as well as straight molds.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A method of recalibrating a worn, conical, especially curved tubular mold for continuous casting of a metal, especially steel, comprising the steps of:

providing a spent, conical tubular mold having a hollow mold compartment;

inserting a conically configured calibration mandril into the hollow mold compartment of the conical tubular mold such that a small end surface of the calibration mandril is introduced into the tubular mold from a side thereof constituting the strand outlet side of the tubular mold prior to such tubular mold having been spent;

applying explosive means to the outer surface of the tubular mold;

detonating said explosive means so that the explosive force of the detonation deforms the tubular mold such that its internal dimensions assume those of the external dimensions of the calibration mandril and the strand outlet side of the tubular mold becomes the metal pouring-in side of the tubular mold which is now capable of being reused; and enlarging the cross-sectional area of the original strand outlet side of the tubular mold, prior to recalibration thereof, in order to facilitate the insertion of the calibration mandril.

2. The method as defined in claim 1, further including the steps of:

enlarging such cross-sectional area of the original strand outlet side of the tubular mold by explosive deformation.

3. The method as defined in claim 2, further including the steps of:

applying said explosive means in the form of explosive charges to four corner regions of the hollow mold compartment and at the central region of the outer surface of the tubular mold; and simultaneously detonating all of said explosive charges.

4. A method of recalibrating a worn, tubular mold used for continuous casting of a metal, comprising the steps of:

providing a spent, tapered tubular mold having a hollow mold compartments;

inserting a tapered calibration mandril into the hollow mold compartment of the tubular mold such that a small end surface of the calibration mandril is introduced into the tubular mold from a side thereof constituting the strand outlet side of the tubular mold prior to such tubular mold having been spent;

applying a force to the outer surface of the tubular mold at least at the region thereof constituting the prior metal pour-in side of the tubular mold prior to its having become spent;

deforming by means of the applied force the tubular mold such that its internal dimensions assume those of the external dimensions of the calibration mandril and such becomes the strand outlet side of the tubular mold which is now capable of being reused; and reversing the taper of the tubular mold by enlarging the side of the tubular mold constituting the strand outlet side prior to recalibration thereof.

5. A method of recalibrating a worn, conical, especially curved tubular mold for continuous casting of a metal, especially steel, comprising the steps of:

providing a spent, conical tubular mold having a hollow mold compartment;

inserting a conically configured calibration mandril into the hollow mold compartment of the conical tubular mold such that a small end surface of the calibration mandril is introduced into the tubular mold from a side thereof constituting the strand outlet side of the tubular mold prior to such tubular mold having been spent;

applying explosive means to the outer surface of the tubular mold;

detonating said explosive means so that the explosive force of the detonation deforms the tubular mold such that its internal dimensions assume those of the external dimensions of the calibration mandril and the strand outlet side of the tubular mold becomes the metal pouring-in side of the tubular mold which is now capable of being reused; and enlarging the cross-sectional area of the original strand outlet side of the tubular mold prior to recalibration thereof.

* * * * *